US005376296A

United States Patent [19]

Dutcher

[11] Patent Number: 5,376,296

[45] **Date of Patent: * Dec. 27, 1994**

[54] AQUEOUS CLEANING COMPOSITION CONTAINING CHLORINATED BLEACH, AN ALCOHOL AND A SURFACTANT

[75] Inventor: Timothy B. Dutcher, Kill Devil Hills, N.C.

[73] Assignee: Armor All Products Corporation, Aliso Viejo, Calif.

[ * ] Notice: The portion of the term of this patent subsequent to Mar. 1, 2011 has been disclaimed.

[21] Appl. No.: 181,025

[22] Filed: Jan. 14, 1994

Related U.S. Application Data

[63] Continuation of Ser. No. 982,378, Nov. 25, 1992, Pat. No. 5,290,470.

[51] Int. Cl.[5] ..... C11D 1/90; C11D 3/02; C11D 3/395; C11D 3/43

[52] U.S. Cl. ..... 252/102; 252/103; 252/104; 252/173; 252/546; 252/547; 252/DIG. 14

[58] Field of Search ..... 252/102, 103, 104, 173, 252/186.36, 186.37, 546, 547, DIG. 14

[56] References Cited

U.S. PATENT DOCUMENTS

| | | | |
|---|---|---|---|
| 3,850,832 | 11/1974 | Wegemund et al. | 252/99 |
| 3,994,744 | 11/1976 | Anderle et al. | 134/4 |
| 4,057,505 | 11/1977 | Nakagawa et al. | 252/96 |
| 4,116,851 | 9/1978 | Rupe et al. | 252/103 |
| 4,229,313 | 10/1980 | Joy | 252/98 |
| 4,287,080 | 9/1981 | Siklosi | 252/104 |
| 4,461,652 | 7/1984 | Richmond | 134/2 |
| 4,470,919 | 9/1984 | Goffinet et al. | 252/102 |
| 4,576,728 | 3/1986 | Stoddart | 252/102 |
| 4,615,821 | 10/1986 | Siklosi | 252/174.25 |
| 4,780,303 | 10/1988 | Dugua | 423/473 |

(List continued on next page.)

FOREIGN PATENT DOCUMENTS 2-180998 7/1990 Japan .

OTHER PUBLICATIONS

Label from 108 Fluid ounce package of "*Mildew Check*" (produced by Pittsburg Paint Co.), (1990) no month available.

Advertising Brochure from "*Mildew Check*" (produced by Pittsburgh Paint Co.), (1990) no month available.

Label from 13 ounce package of "*Dekswood*" (produced by Flood Co.), (1990) no month available.

Advertising brochure for "*Dekswood*" (produced by Flood Co.), (1990) no month available.

(List continued on next page.)

*Primary Examiner*—Dennis Albrecht

*Attorney, Agent, or Firm*—Burns, Doane, Swecker & Mathis

[57] ABSTRACT

A composition comprising: (A) about 1 to about 10 percent by volume of a surfactant that is miscible with water and compatible with chlorinated bleach solutions; (b) about 0.1 to about 8 percent by volume of one or more alcohols selected from the group consisting of a primary, secondary and tertiary alcohol which is compatible with concentrated chlorinated bleach solutions; (C) about 1 to about 4 percent by volume of a chlorinated bleach solution with a caustic override in an approximate amount needed to maintain chlorine stability in the composition; and (D) the balance being water. The composition is useful as a cleaning composition for various outdoor surfaces including wood, vinyl, fiberglass, ceramic tile, concrete, brick, canvas, stone, and plastics. The composition is especially effective for cleaning wood, vinyl siding, and preparation cleaning of outdoor painted surfaces.

12 Claims, No Drawings

U.S. PATENT DOCUMENTS

| | | | |
|---|---|---|---|
| 4,806,263 | 2/1989 | Leathers | 252/106 |
| 4,839,079 | 6/1989 | Wainberg et al. | 252/104 |
| 4,978,469 | 12/1990 | Seaman, Jr. | 252/170 |
| 5,008,031 | 4/1991 | Schulz et al. | 252/168 |
| 5,075,025 | 12/1991 | Wainberg et al. | 252/95 |
| 5,089,162 | 2/1992 | Rapisarda et al. | 252/102 |
| 5,108,660 | 4/1992 | Michael | 252/545 |
| 5,290,470 | 3/1994 | Dutcher | 252/102 |

OTHER PUBLICATIONS 12.8 ounce box package from "*Fresh Deck*" (produced by Olympic Homecare Products), (1990) no month available.

12.8 ounce envelope package from "*Fresh Deck*" (produced by Olympic Homecare Products), (1990) no month available.

6.4 ounce packaging from "*Deck Brightener*" (produced by Kop–Coat, Inc.), (1990) no month available.

13 ounce packaging from "*Woodbrite*" (produced by Osmose Wood Preserving, Inc.), (1990) no month available.

Advertising brochure from "*Woodbrite*" (produced by Osmose Wood Preserving, Inc.), (1990) no month available.

Brochure for "*DeckBoss*", Aug. 16, 1992 no month available.

Brochure for "*E–Z Deck*", Feb., 1991 no month available.

AQUEOUS CLEANING COMPOSITION CONTAINING CHLORINATED BLEACH, AN ALCOHOL AND A SURFACTANT

This application is a continuation, of application Ser. No. 07/982,378, filed Nov. 25, 1992, now U.S. Pat. No. 5,290,470.

FIELD OF THE INVENTION

The present invention relates to cleaning compositions and methods of use thereof, and more particularly, the present invention relates to a cleaning composition and method that cleans mold, mildew, algae, grease, and stains from a variety of surfaces including natural wood, stucco, concrete, and other hard surfaces, without having to brush, scrub or otherwise physically work the cleaning composition in the soil or soiled surface.

BACKGROUND OF THE INVENTION

Numerous cleaning products are currently being marketed in order to clean different types of wood which are used to make decks, fences, siding, and so forth. Examples of products on the market which are sold for these purposes include MILDEW CHEK, DECK BRIGHT, JOMAR, CEDAR CLEAN, and WOLMAN DECK BRIGHTENER. All of the these products require some type of scrubbing or brushing in order to achieve the stated purpose. Further, many of these products require mixing or measuring of some sort and therefore are very susceptible to being mixed improperly and being ineffective or being an environmental and safety hazard. Many of the products also harm plants, fish, animals, or birds which can destroy the landscaping around and/or wild life around the structure being cleaned.

As further background to the present invention, several different acids can be used to clean various types of wood, concrete, and other outside surfaces. However, no single acid will clean mold, mildew, algae, organic stains, and remove dirt without harming one or all of a variety of surfaces to be cleaned.

Also, any one of several products currently being marketed to clean outside surfaces recommend brushing, scrubbing, mixing with other ingredients and/or mention incompatibility with some surfaces.

Additionally, chlorine bleach is often used to clean outside surfaces. However, although it will do a good job, even the manufacturers of chlorine bleach do not recommend it for this use because used alone, the bleach will dry wood too much and cause the knots to shrink and fall out. It will also cause wood to cup when exposed to direct sunlight.

Further, there are many products that consist of poisonous petroleum based chemicals that will kill mold, mildew, fungus, and algae, but there are none with a combination and compatibility of chemicals that are safe and environmentally degradable.

Finally, one product, marketed by one of the present inventors (and disclosed in co-pending U.S. application Ser. No. 07/822,130, abandoned in favor of copending application Ser. No. 08/032,547), cleans outside surfaces without requiring brushing, scrubbing or mixing with other ingredients. The composition contained, by volume, 1 percent lauryl betaine, 0.5 percent isopropyl alcohol, 5 percent sodium hypochlorite (stabilized with excess sodium hydroxide), and the remainder being water. However, recently it was found that this composition caused the nap of wood to raise and caused some of the other outside surfaces such as certain fabrics to deteriorate more rapidly than normal. This composition also left white scum on some hard surfaces such as wood. These, of course are undesirable side effects.

Accordingly, the present inventors set out to solve the problem of raising the nap of wood while at the same time maintaining an effective cleaner that did not require brushing, scrubbing or mixing with other ingredients. As a result, the present invention was made.

SUMMARY OF THE INVENTION

Accordingly, one object of the present invention is to provide a cleaning composition that will clean a variety of outdoor surfaces in addition to wood with absolutely no scrubbing or brushing, and which unexpectedly does not cause the nap of wood to raise, does not prematurely deteriorate certain outside surfaces, and does not form a white scum on any hard surfaces cleaned.

It is also an object of this invention to provide a cleaning composition that can be sold full strength, so that mixing or measuring is not required, thereby leaving room for improper mixing resulting in ineffectiveness or being an environmental and safety hazard.

It is also an object of this invention to provide a cleaning composition which can be sold full strength and maintain maximum performance while at the same time being so mild that when used as directed will effectively clean without harming the environment such as plants, fish, animals, or birds.

It is an even further object of the present invention to provide a cleaning composition for outdoor surfaces which is biodegradable and quickly breaks down into inert materials.

These and other objects have been achieved by providing a composition comprising:

(A) about 0.1 to about 10 percent by volume of a surfactant that is miscible with water and compatible with concentrated chlorinated bleach solutions;

(B) about 0.1 to about 8 percent by volume of one or more alcohols selected from the group consisting of a primary, secondary and tertiary alcohol which is compatible with concentrated chlorinated bleach solutions and;

(C) the balance being a 1–4% aqueous chlorinated bleach solution with a caustic override in an approximate amount needed to maintain chlorine stability in the composition.

Also provided is a method for cleaning soiled outdoor surfaces comprising the steps of:

I. applying the above-described cleaning composition to the soiled surfaces, and II. after a period of time sufficient to remove the soil, rinsing the surface by spraying with water.

In a preferred embodiment, the alcohol is isopropyl alcohol and the bleach solution is a sodium hypochlorite or potassium hydrochlorite bleach solution, and especially preferably sodium hypochlorite bleach solution.

DETAILED DESCRIPTION OF THE INVENTION

The above-described composition is new in the industry because it is the only composition formulated with a combination of chemicals that are considered to be mild household cleaners but works as fast as most dangerous acids and has no disadvantages such as raising the nap of wood, causing some outside surfaces to deteriorate more rapidly than normal, or leaving a white scum. In actual field tests, the presently claimed composition dramatically out-performed every product that could be found available in and was sold in major hardware, paint, and marine stores in the United States. It also out-performed the cleaning composition disclosed and claimed in copending U.S. application Ser. No. 07/822,130.

Further, the combination of ingredients is unique in that the chlorinated bleach solution will clean mold, mildew, fungus, algae, and other stains on outdoor surfaces, but at the same time the surfactant or surfactants act as a buffer in that they combine with and retard the harshness of the chlorinated bleach solution and enhance the action of the chlorinated bleach solution by emulsifying organic oils and any animal fatty acids and dirt residue. The surfactants are also penetrants that will actually penetrate porous surfaces and help lift the foreign matter to the surface for easy removal. The alcohol serves two purposes: first, it helps the chlorinated bleach to slightly raise the grain in wood so the wood will more easily release the foreign matter and cleaning action can take place with no labor, and second, it also acts as a drying agent on the emulsified organic oils so that they tend to thicken and stick together for easier removal. With this combination of ingredients, the pressure from the average garden hose is all that is needed to cause the surface to be cleaned. This action is unsurpassed in cleaning and preparing surfaces and especially wood, for painting, staining, or sealing.

Importantly, and unexpectedly, the composition does not cause the nap of wood to raise, does not cause premature deterioration of other materials such as some fabrics, and does not form a white scum on cleaned surfaces, as did its commercialized forerunner, which used about 5 percent by volume of a 100 percent chlorinated bleach solution.

According to the present invention, the surfactant can be any surfactant that is miscible with water and compatible with concentrated chlorinated bleach solutions. The phrase "compatible with concentrated chlorinated bleach solutions" means that the surfactant and chlorinated bleach solutions are soluble in each other without reacting or changing their chemical composition. The surfactant must be suitable for storage with hypochlorite solutions without loss of its cleaning ability and without reaction.

The surfactant emulsifies the oils and dirt impregnated in the wood or surface being cleaned as well as any perfume or odorant oils added to the inventive composition. Further, the surfactant emulsifies undesirable materials in and on the surface being cleaned and helps remove these undesirable materials such as oxidized oils and dirt. The surfactant also serves as a buffer to prevent raising the wood grain by the hypochlorite solution.

Preferably, the surfactant is an amine oxide, a lauryl betaine, an ethoxylated carbon chain compound and/or a sulfonated carbon chain compound.

Specific examples of such surfactants suitable for use in the present composition include a lauryl dimethyl amine oxide, a lauryl betaine, an ethoxylated hydrogenated tallow amine, a nonylphenol ethoxylated or triethanol amine salt of an alkylauryl sulfonate or an octylphenoxy polyethoxy ethanol. An amine oxide, a lauryl betaine, or an octylphenoxy polyethoxy ethanol are especially preferred.

The surfactant can be one or a combination of surfactants and the total percent by volume ranges from about 0.1 to about 10 percent. The preferred amount of surfactant is about 1 percent by volume.

According to the present invention, the alcohol can be any of a primary, secondary or tertiary alcohol, as long as it is compatible with concentrated chlorinated bleach solutions. The phrase "compatible with concentrated chlorinated bleach solutions" means that the alcohol and chlorinated bleach solutions are soluble in each other without reacting or changing their chemical composition.

Specific examples of suitable alcohols that are useful in the present composition, on a 100 percent basis, include methyl alcohol, ethyl alcohol and its denatured counterparts, and isopropyl alcohol.

Isopropyl alcohol and/or methyl alcohol are preferred. Ethyl alcohol and its denatured counterparts are less desirable because of high cost and the complexity of the denaturant formulas. Higher alcohols such as butyl, octyl, and decyl alcohol are not desirable because they dry too slowly.

The alcohol aids the penetration of the surfactant and bleach (hypochlorite) into the surface and helps emulsify undesirable oils. The alcohols can be used alone or in combination.

The alcohol is used in an amount of from about 0.1 to about 8 percent by volume, and an amount of about 0.5 to 1.2 percent by volume is preferred.

According to the present invention, the chlorinated bleach solution can be any of sodium hydrochlorite, potassium hypochlorite or calcium hypochlorite. Calcium hypochlorite is less preferred because the calcium ion is relatively insoluble and causes surfactants, soaps or detergents to become inactive.

In the present composition, hypochlorite removes the stains caused by mold, mildew, fungus and algae usually associated with dampness and moisture. The chlorinating and oxidizing action of the hypochlorite solution whitens and brightens the surface cleaned and returns it to a stain and dirt free surface as when new.

The bleach solution is used in an amount of from about 1 to about 4 percent by volume of a 100 percent chlorinated bleach solution, and about 3 percent by volume is preferred.

The present inventors have unexpectedly found that compositions with greater than about 4.0 percent bleach cause the nap of wood to raise and compositions with less than about 1.0 percent bleach are cleaners in themselves. However cleaning time is excessively long. The inventive composition cleans effectively in minutes whereas concentrations of less than 1.0 percent bleach require hours, thereby making the job labor intensive. Concentrations less than 1.0 percent may require repeated applications of the solution to match the effective cleaning of the inventive composition.

Bleach solutions are stabilized by the addition of excess alkali, usually sodium hydroxide (sometimes referred to as caustic or alkali or lye) in the manufacturing process in order to prevent loss of chlorine. This practice is commonly referred to as an "override" of caustic, e.g., sodium hydroxide. The present inventors have found that excess alkali, e.g., sodium hydroxide, in the bleach solution causes raising of the nap of wood and deterioration of fabrics and products sensitive to sodium hydroxide. The present inventors have also found that excessive alkali, e.g., sodium hydroxide, causes a white scum to form on some hard surfaces such as wood. Reducing the "override" of the caustic reduces this effect and also reduces the pH of the solution.

The "override" is sometimes on the order of 1.5 percent by volume of alkali, e.g., sodium hydroxide, with 0.7 percent being the norm. This results in a pH of 11.5 to 11.7. Reducing the "override" to about 0.4 to about 0.6 percent in the final composition maintains the chlorine stability yet reduces the pH to 11.25. Thus, the lower the alkali content of the bleach solution the less the deleterious effect.

According to the present invention, the caustic override in the final composition is an approximate amount needed to maintain chlorine stability and yet avoid the deleterious effects of the bleach. The amount is an approximate amount, because a slightly higher amount than is needed to maintain chlorine stability can be tolerated without producing the deleterious effects. The skilled artisan can readily determine the approximate amount of caustic suitable for use in the composition of the present invention.

The balance of the composition is water or water and other additives which do not affect the efficacy of the composition. The water can be tap water, deionized water or distilled water. Examples of other ingredients that can be used in the composition include perfumes, odorants and/or masking agents for the odors of the hypochlorites and colorants. In addition certain silicones such as those used in the car wash industry commonly called amino-functional may be added to leave the wood water proofed for a short period of time after cleaning. The silicone must be compatible with the oil or solvent based final water proofing applied after using the composition of the present invention. Suitable perfumes, odorants and/or masking agents as well as suitable silicones can be readily selected by those skilled in the art of manufacturing silicones and their emulsions. Examples of suitable silicones include the aminofunctional type such as those sold under the trade names "DOW 531" and "DOW 536" and aminofunctional silicones which are offsets to the DOW materials such as those manufactured by General Electric, Waccker Silicones, P.P.G. and others, both foreign and domestic.

The silicone additives are used in an amount of from 1 to 5 percent by volume of the final composition, which will be an emulsion.

Suitable amounts of the other additives can be readily determined by those skilled in the art.

The composition according to the present invention can be used to clean a broad range of surfaces. The composition is unusual in that it can be used on such a wide range of materials. Any kind of wood (pine, cedar, redwood, mahogany, salt treated, juniper, cypress, etc.) can be treated, with the exception of teak. Other surfaces which can be cleaned with the inventive composition include vinyl, fiberglass, ceramic tile, concrete, brick, canvas, stone, roof shingles made of asphalt, wood, tile, or fiberglass, plastics, and aluminum. The composition has been used on vinyl and wood sided houses, wooden decks, concrete walkways and driveways, fiberglass boats, vinyl and plastic lawn furniture, tile, roof shingles, brick and stone. In all cases, the same ultra-fast amazing results were obtained.

The most appealing aspect of the inventive composition to the consumer is that it can be applied by virtually any method, including brushing, pouring, brooming, or spraying, including high pressure or low pressure as obtained, for example, from a garden hose. The most efficient method of application is spraying. The composition is then let to stand until visually clean, e.g., about 10 minutes, and washed off with water, usually by spraying the water from a garden hose.

The coverage of the inventive composition ranges from about 200 square feet to about 300 square feet per gallon. The difference depends upon the type and condition (e.g. dryness) of the surface. Thus a smooth hard surface, such as fiberglass, will require less than an old dried out wood surface. The necessary coverage can readily be determined by first testing a small area of the surface to be cleaned.

The newly cleaned wood will last for many months and if unprotected will simply age as it did before. Other surfaces such as ceramic tile, concrete, brick, fiberglass, stone, and canvass will collect dirt and stains as they did before and over a period of months will require recleaning.

The present invention will now be described by means of examples, which are not meant to be limiting. Unless otherwise specified, all percents, parts, and ratios are by volume.

EXAMPLES

In all of the examples, the cleaning composition had the following components (all percents are by volume):

(A) 1.0 percent lauryl betaine,
(B) 0.5 percent isopropyl alcohol,
(C) 3.0 percent sodium hypochlorite with a caustic override of 0.35 and a pH of approximately 11.2,
(D) 95.0 percent water, and
(E) 0.5 percent perfume.

EXAMPLE 1

A deck made of southern yellow pine, commonly referred to as "pressure treated" lumber was treated as described below. Pressure treated lumber is the most widely used type of lumber to build outside decks and docks. The deck was approximately ten years old. It also was surrounded by flowers and a small vegetable garden.

(1) A low pressure standard pump-up type garden sprayer was used to apply the composition to a large test area while the surface was dry.
(2) The surface started to change to a lighter cleaner look within twenty seconds. However, upon close inspection some spots were found that were not uniformly cleaned so the composition was allowed to remain on the surface for a total of ten minutes. At the end of ten minutes the deck was uniformly clean and nearly all mildew, algae and direct stains had been removed. No other chemicals or cleaning methods were used to brush, scour, rub or agitate the applied composition in any manner.
(3) The house water system and a garden hose equipped with a standard pressure nozzle was used to rinse and wash away the residue. The test area was left to dry for three hours. Inspection of the dried test area of the deck showed that it had been thoroughly cleaned and was visually free of any mildew, algae, and dirt stains.
(4) The deck was inspected several times over a thirty day period and no problems were found whatsoever. The cleaning job was very satisfactory and there was no damage to the wood, nails or surrounding vegetation.
(5) An inspection was performed about 105 days after the initial application, and no problems were apparent.

EXAMPLE 2

A house with horizontal lap siding was treated as described below. The siding was white cedar wood which is a commonly used wood for siding houses, particularly along coastal areas. The wood is usually not painted or stained and is applied in its natural state. This house had the original siding and was approximately six years old. It was surrounded by flowers and a nice green grass lawn.

(1) A low pressure standard pump-up type garden sprayer was used to apply the composition to a large test area while the surface was dry.

(2) The surface started to change color and appear cleaner within twenty seconds. Some of the more dense wood fibers reacted slower but the entire surface was visually cleaned in ten minutes. Inspection of the cleaned test area showed that the surface was clear of all visual mildew, algae and stains. No other chemicals or cleaning methods were used to clean the surface.

(3) The house water system and a garden hose equipped with a standard pressure nozzle was used to rinse and wash away the residue. The end result was a dramatically clean looking surface that was visually free of all mildew, algae and stains.

(4) The house was inspected monthly for more than eight months and no adverse effects to the surface or surrounding areas were found.

EXAMPLE 3

A concrete walkway was treated as described below. The residence was located in a heavily wooded area and the walkway exhibited the typical black residue that builds up on surfaces located in wooded areas.

(1) A low pressure standard pump-up type garden sprayer was used to apply the composition to a large test area while the surface was dry.

(2) The initial cleaning action was clearly visible in thirty seconds and the cleaning was complete in approximately ten minutes. No other chemicals, scrubbing or any other type of cleaning action was used.

(3) The house water system and a garden hose that was equipped with a standard pressure nozzle was used to rinse the surface and wash away the residue and stains from the concrete test area.

(4) The test area was allowed to dry (two hours) and the results were then inspected. The concrete surface was visually cleaned and free from mildew, algae, tree and dirt stains.

(5) An inspection fourteen days later showed that the surface was still clean and had no damage to the surface or surrounding areas. The area was reinspected several times over a six month period and each time the inspection found the results still to be very satisfactory.

EXAMPLE 4

A vinyl sided house which is typical of the vinyl siding used by the housing industry nationwide was treated as described below.

(1) A low pressure standard pump-up type garden sprayer was used to apply the composition to a large test area while the surface was dry.

(2) The initial cleaning action was visible in less than thirty seconds. The surface appeared to be totally cleaned at the end of ten minutes. No other chemicals or cleaning action of any description were used.

(3) The house water system and a garden hose that was equipped with a standard pressure nozzle was used to rinse the test surface.

(4) The test area was then left to dry for one hour. Inspection of the dried surface found it to be thoroughly cleaned and free from all visible mildew, algae, tree and dirt stains.

(5) The test area was inspected three more times in the following thirty days and no adverse effects or damage to the surface or surrounding painted surfaces or vegetation were found.

While the invention has been described in detail and with reference to specific embodiments thereof, it will be apparent to one skilled in the art that various changes and modifications can be made therein without departing from the spirit and scope thereof.

What is claimed is:

1. An aqueous biodegradable cleaning composition for cleaning outdoor wood surfaces, the cleaning composition consisting essentially of:

about 0.1 to about 10 percent by volume of a surfactant that is miscible with water and compatible with concentrated chlorinated bleach solutions;

about 0.1 to about 8 percent by volume of one or more alcohols selected from the group consisting of primary and secondary alcohols having 1 to 3 carbon atoms and mixtures thereof; and the balance being an aqueous chlorinated bleach solution with a caustic override in an amount of about 0.35% to maintain chlorine stability in the composition but prevent deterioration of the wood surfaces, the bleach solution having a hypochlorite content of about 3%.

2. The composition of claim 1, wherein:

said surfactant is present in an amount of about 1 percent by volume;

said alcohol is present in an amount of about 0.5 to 1.2 percent by volume; and said bleach solution is a 3 percent bleach solution.

3. The composition of claim 1, wherein said alcohol is isopropyl alcohol.

4. The composition of claim 2, wherein said alcohol is isopropyl alcohol.

5. The composition of claim 1, wherein the surfactant is selected from the group consisting of a sulfonated surfactant, an amine oxide surfactant, a betaine surfactant and mixtures thereof.

6. The composition of claim 2, wherein the surfactant is selected from the group consisting of a sulfonated surfactant, an amine oxide surfactant, a betaine surfactant and mixtures thereof.

7. The composition of claim 1, wherein said bleach solution is a sodium hypochlorite bleach solution.

8. The composition of claim 2, wherein said bleach solution is a sodium hypochlorite bleach solution.

9. The composition of claim 1, which additionally contains an odorant, perfume and/or masking agent.

10. The composition of claim 2, which additionally contains an odorant, perfume and/or masking agent.

11. The composition of claim 9, wherein:

said alcohol is isopropyl alcohol; and said bleach solution is a sodium hypochlorite bleach solution.

12. The composition of claim 10, wherein:

said alcohol is isopropyl alcohol; and said bleach solution is a sodium hypochlorite bleach solution.

* * * * *

Disclaimer 5,376,296—Timothy B. Dutcher, Kill Devil Hills, N.C. AQUEOUS CLEANING COMPOSITION CONTAINING CHLORINATED BLEACH, AN ALCOHOL AND A SURFACTANT. Patent dated December 24, 1994. Disclaimer filed October 14, 1997, by the assignee, Armor All Products Corp.

The term of this patent subsequent to October 1, 1997, has been disclaimed.

*(Official Gazette,* December 9, 1997)